United States Patent [19]

Aulenbacher

[11] 4,047,568

[45] Sept. 13, 1977

[54] METHOD AND APPARATUS FOR CUTTING AND RETRIEVING CASING FROM A WELL BORE

[75] Inventor: Merle W. Aulenbacher, Conroe, Tex.

[73] Assignee: International Enterprises, Inc., Houston, Tex.

[21] Appl. No.: 680,472

[22] Filed: Apr. 26, 1976

[51] Int. Cl.[2] ..... E21B 23/00; E21B 29/00; E21B 31/02

[52] U.S. Cl. ..... 166/298; 166/216; 166/240; 166/301; 166/55.8

[58] Field of Search ..... 166/297, 298, 301, 55.7, 166/55.8, 55.6, 55, 216, 98, 217, 99, 240, 138, 209

[56] References Cited

U.S. PATENT DOCUMENTS

| | | | |
|---|---|---|---|
| 2,117,594 | 5/1938 | Barrett | 166/55.7 |
| 2,906,344 | 9/1959 | Clark, Jr. | 166/216 |
| 2,991,834 | 7/1961 | Kennard | 166/55.7 |
| 3,026,941 | 3/1962 | Muse | 166/216 |
| 3,344,862 | 10/1967 | Conrad | 166/216 |
| 3,782,459 | 1/1974 | Murray | 166/.5 |

*Primary Examiner*—Stephen J. Novosad

*Attorney, Agent, or Firm*—Browning, Bushman & Zamecki

[57] ABSTRACT

An apparatus for cutting and recovering casing from a well which includes a well string having a swivel mounted thereon, a gripping assembly, a lower drive cone, and a cutter mounted on the lower end of the well string, the swivel functioning as the expander or drive cone for the gripping assembly to set the cutter at any desired level within a casing to be cut and the gripping assembly which has been expanded by the swivel to set position functioning to support the swivel for rotation of the string during a cutting. The method of cutting and retrieving casing from a well bore including the steps of lowering the apparatus into the bore, setting the gripping assembly by lowering the swivel to expand the gripping elements so that the gripping assembly supports the swivel at the desired level, cutting the casing by rotation of the well string and expanding the cutter, raising the string to remove the swivel from set position with respect to the gripping assembly and to bring the lower drive cone into position setting the gripping assembly into gripping engagement with the cut casing, and raising the string to retrieve the string and the severed casing supported thereon from the well bore.

20 Claims, 8 Drawing Figures

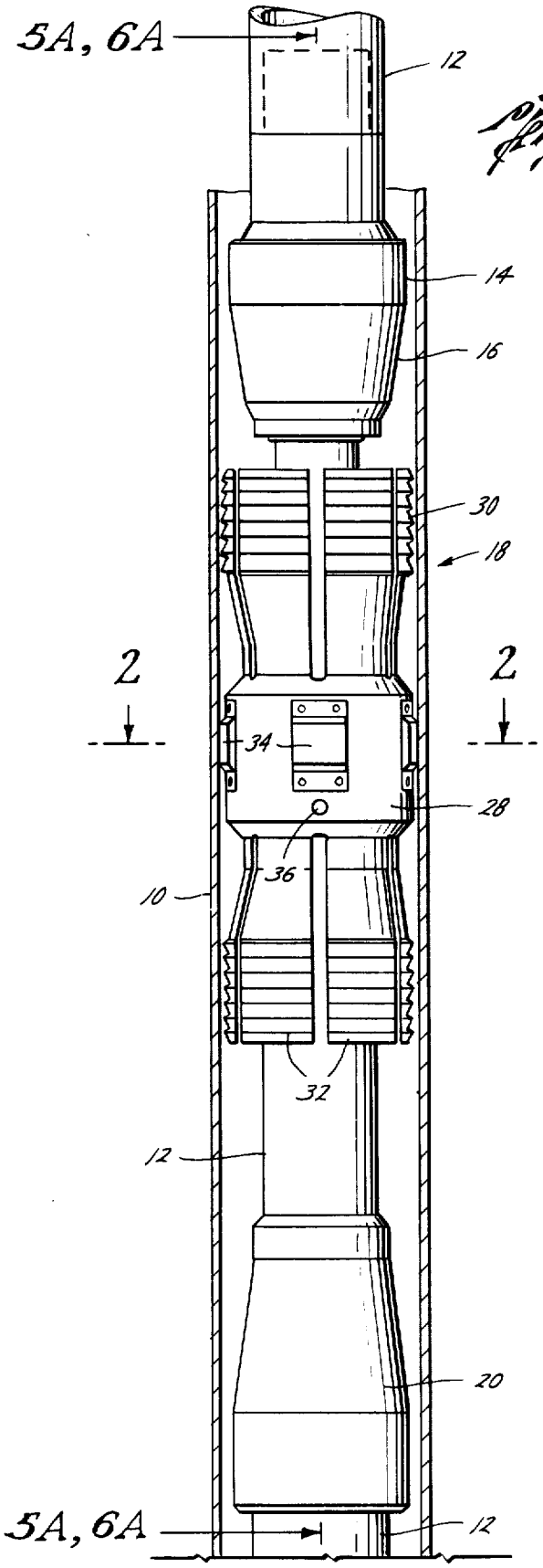
Fig. 1
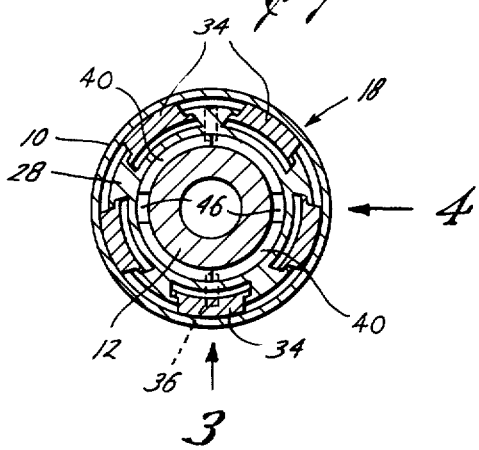
Fig. 2
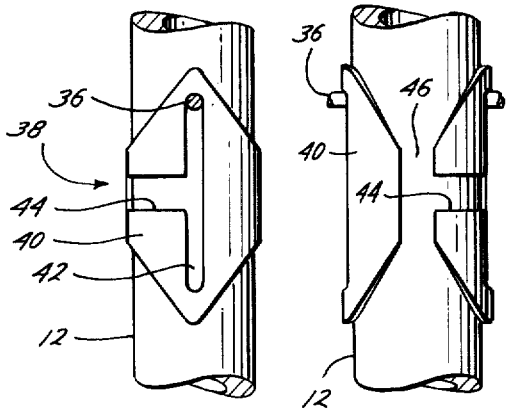
Fig. 3
Fig. 4

METHOD AND APPARATUS FOR CUTTING AND RETRIEVING CASING FROM A WELL BORE

BACKGROUND OF THE INVENTION

Casing in a well is often to be cut to recover the casing or for other reasons. In the past a string has been lowered with the location of the cut being determined by the length of string lowered into the well bore or by collar locators. It is particularly important in the cutting of casing that the cutter be held in the same level during cutting. This usually results in the use of a swivel seated in the well head when drilling from a floating structure.

The W. K. Murray Pat. No. 3,782,459 discloses a cutting string with a swivel supported by a gripping assembly. The cut casing is raised by the collar locators. The M. B. Conrad Pat. No. 3,344,862 discloses a combined tubing anchor, collar locator and swivel used in the cutting of casing within a well bore.

SUMMARY

The present invention relates to an improved method of cutting and recovering the cut casing and the improved apparatus therefor. The improved apparatus includes a section of a well string, a swivel, a gripping assembly, a lower drive cone, and a cutter with the swivel functioning as a drive cone or expander for the gripping elements during cutting and the lower drive cone functioning to set the gripping assembly to support the cut casing for retrieval. The improved method of the present invention includes the step of lowering the improved apparatus into the well bore, setting the gripping assembly by lowering the swivel to expand a set of gripping elements and so that the gripping assembly supports the swivel at the desired level, cutting the casing, raising the string to remove the swivel from the gripping assembly and to set the gripping assembly with the lower expander cone and retrieving the string with the severed casing supported thereon.

An object of the present invention is to provide an improved method of and apparatus for cutting casing within a well bore where the cut may be made at any level independent of the location of casing joints or collars.

Another object is to provide an improved method of and apparatus for the cutting and recovering of casing within a well which may be simply and readily accomplished by a single round trip of the apparatus into and out of the well bore.

BRIEF DESCRIPTIONS OF THE DRAWINGS

These and other objects and advantages of the present invention are hereinafter more fully set forth and explained with reference to the drawings wherein:

FIG. 1 is an elevation view of a portion of the improved apparatus of the present invention showing it in position of being run into the casing which is to be severed.

FIG. 2 is a transverse sectional view of the gripping assembly taken along lines 2—2 in FIG. 1.

FIG. 3 is a side elevation view to show the means for restraining the movement of the gripping assembly with respect to the drill string which involves a J-slot and pin construction.

FIG. 4 is another side elevation view similar to FIG. 3 showing the remainder of the J-slot construction.

FIG. 5A illustrates the upper portion of the structure and 5B illustrates the lower extension of such structure.

FIG. 6A illustrates the upper portion of the apparatus and FIG. 6B illustrates the lower extension of the apparatus below the portion shown in FIG. 6A.

DESCRIPTION OF THE PREFERRED EMBODIMENT

Figure 5A:
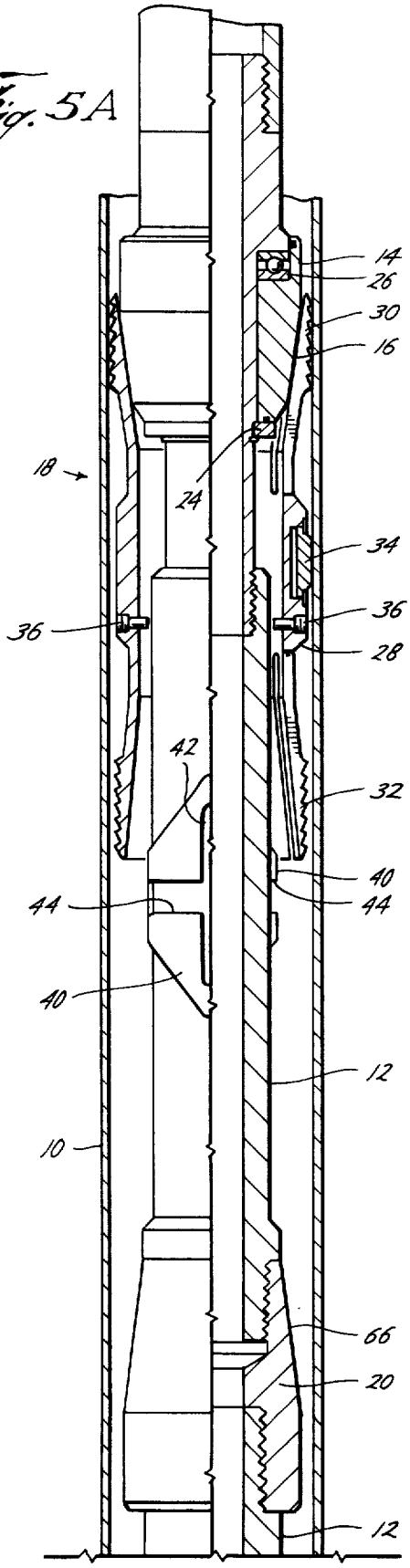
FIGS. 5A and 5B are views partly in section and partly in elevation illustrating the position of the apparatus of the present invention in the well bore during cutting of the casing.

The improved apparatus of the present invention is illustrated in FIG. 1 within the casing 10 which lines the well bore (the lower cutter not being shown). The casing 10 may be a single or multiple casings which are desired to be severed and retrieved from the well bore. The apparatus, as illustrated in FIG. 1, includes the well string 12, the swivel 14 mounted on the well string 12 and having a lower tapered surface 16 which tapers downward and inward to coact with the gripping assembly 18 (as hereinafter described), and the lower drive cone 20, and the cutter 22 shown in FIGS. 5B and 6B.

As shown in FIG. 5A the swivel 14 is rotatable about the well string or mandel 12 and is supported thereon by the ring 24 with the bearings 26 allowing rotation therebetween without any substantial frictional drag which would interfere with the cutting.

The gripping assembly 18 includes the sleeve 28, the upper gripping elements 30, the lower gripping elements 32, the drag blocks 34 and the means for limiting the actual movement of sleeve 28 with respect to the well string 12. As shown the sleeve 28 is held relatively centered between the swivel 14 and the lower drive cone 20 during running of the apparatus into the well bore. The drag blocks are urged outwardly against the interior of the casing 10 so that the gripping assembly resists axial movement with the well string 12 until it is positively moved to a position at which its axial movement is not limited.

The releasable movement limiting means includes the pins 36 which extend through and are supported on the sleeve 28 and the J-slots 38 which are formed in the pads 40 rigidly carried by or integral with the well string or mandel 12 as best shown in FIGS. 3 and 4. The pins 36 are adapted to be positioned in the J-slots 38 as shown. As can be seen from FIGS. 3 and 4 the J-slots 38 each have a vertical slot 42 and a horizontal slot 44 which intersects with the mid point of the vertical slot 42 and extends outwardly to the open area 46. Whenever it is desired to allow substantial relative movement of the well string 12 with respect to the gripping assembly 18 the lowering of the well string is stopped, the well string 12 is lifted and rotated to the left to move the pins 36 to the mid point of the vertical slot 42, through the horizontal slot 42 and into the open space 46. With the pins 36 in the open space 46 such movement limiting means no longer restricts the relative axial movement between the well string 12 and the gripping assembly 18. Thereafter the well string 12 may be either lowered or raised with respect to the gripping assembly 18 and the friction blocks 34 which are urged outwardly into engagement with the casing 10 by suitable springs (not shown) will maintain the gripping assembly 18 in its position within the casing while the well string 12 is moved axially relative thereto. For purposes of clarity FIGS. 3 and 4 illustrate only the well string 12, the pads 40, and the pins 36 with the remainder of the gripping assembly having been removed.

As shown the two sets of gripping elements 30 and 32 are integral with respect to the body 28 and have a relatively thin section near the body 28 so that they are sufficiently flexible to be wedged outward to gripping engagement with the interior of the casing 10.

Figure 6A:
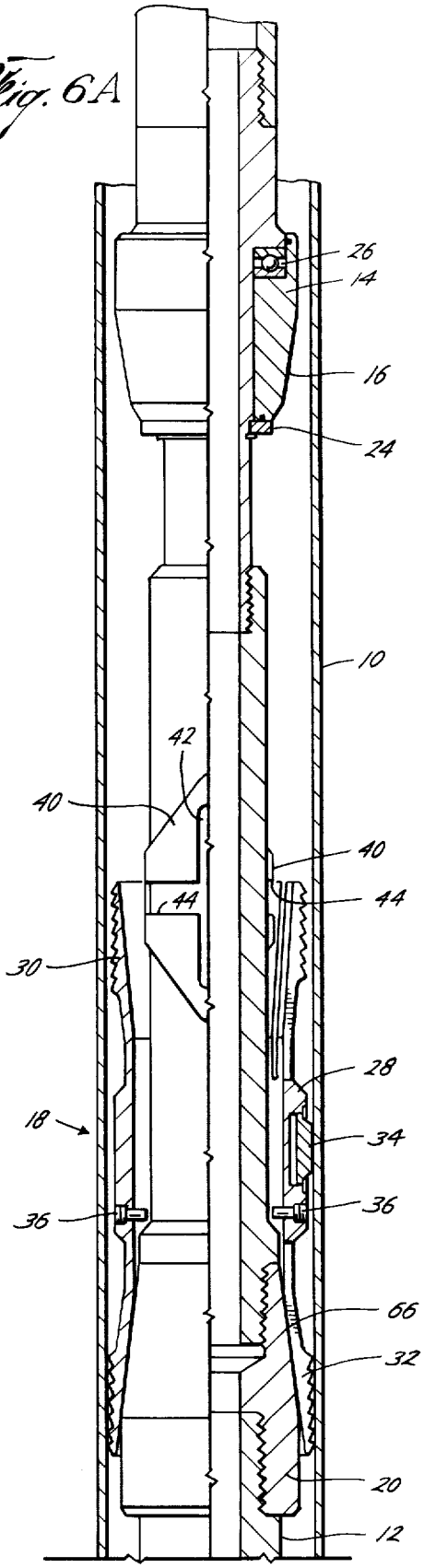
FIGS. 6A and 6B are similar views of the apparatus illustrating the position of such apparatus in its retrieval of the string and of the severed casing.
Figure 5B:
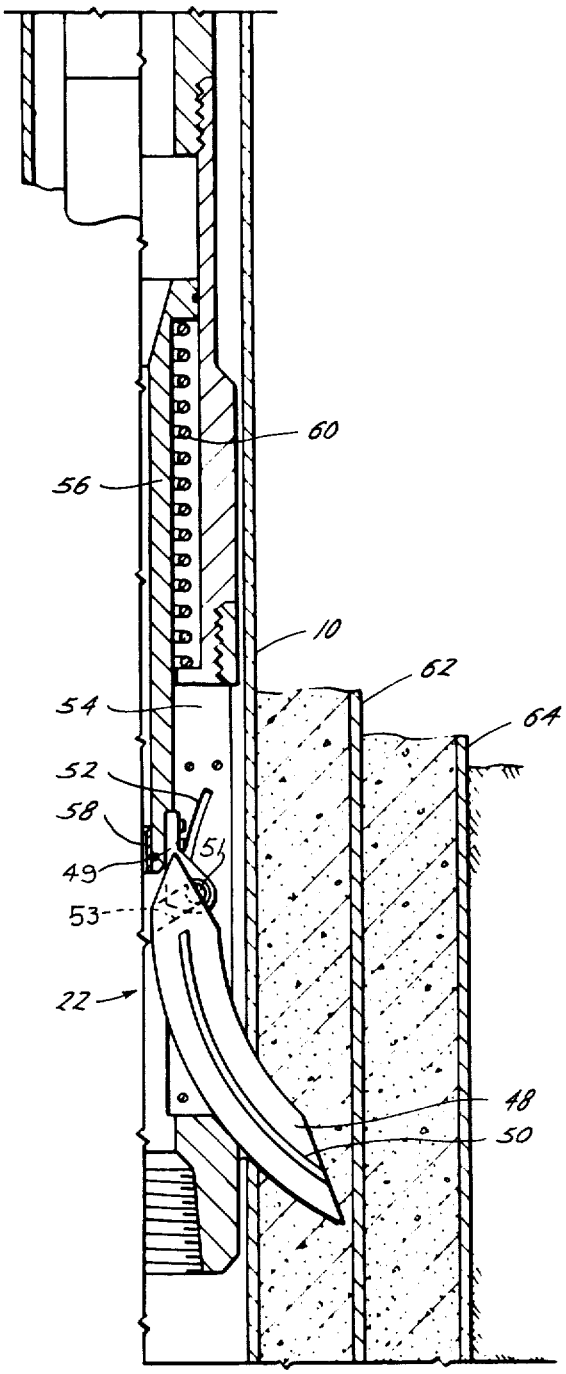
Figure 6B:
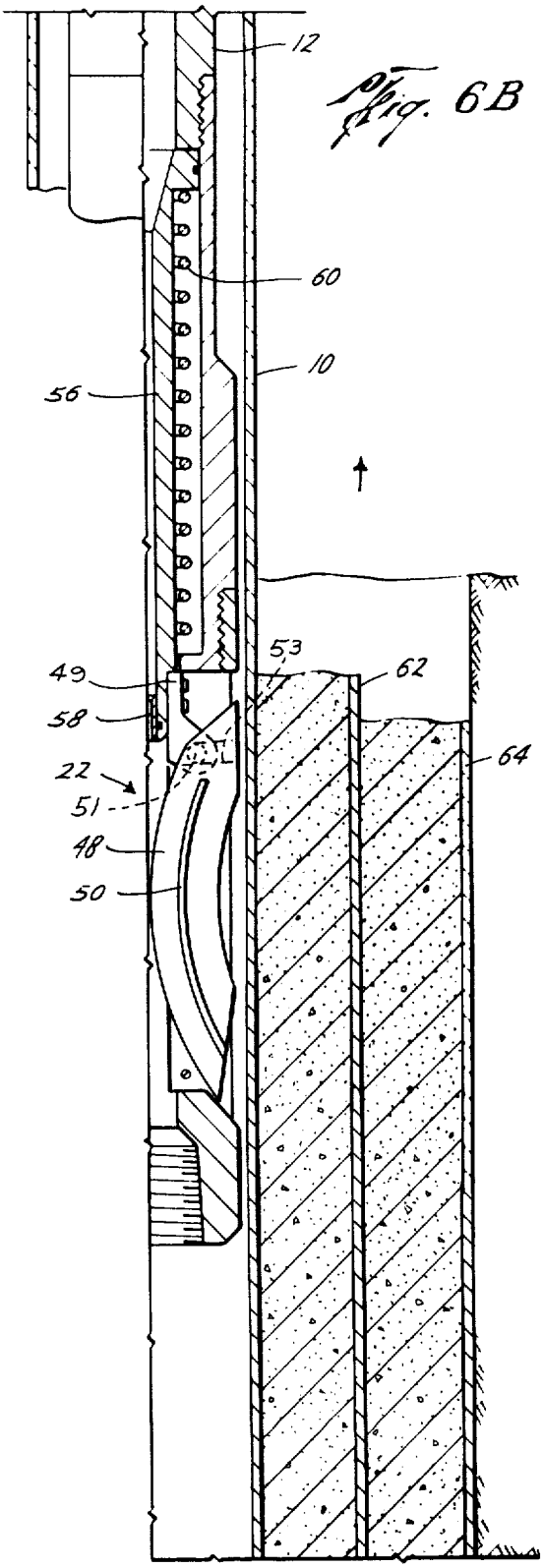

The cutter 22 is preferably of a type which is capable of cutting through the entire casing or set of casings so as to cooperate with the ability of the other parts of the tool to allow cutting and retrieval of the casing in a single round trip of the tool into and out of the well. Although many different types of cutters may be used, the preferred cutter 22 illustrated is of the type more fully disclosed in my copending application Serial No. 680,470, filed May 26, 1976. Briefly, the cutter 22 has suitable blades 48 having guiding connections including the ribs 50 on the side surfaces of the blades 48 which are in engagement with respective mating slots 52 in the body 54 of the cutter 22. Only one of the blades 48 is shown, and it should be realized that the cutter includes a number, say three, of identical blades arranged symmetrically about the tool centerline. The rib 50 on one side of the blade 48 is shown. There is an identical rib (not shown) on the other side of the blade 48 which is engaged in the slot 52 which is shown in FIG. 5B. The piston 56 is axially movable within the body 54 and includes an orifice or restriction 58 so that the piston 56 moves downwardly therein responsive to the circulation of the drilling fluid through the well string 12. The spring 60 is positioned to urge the piston 56 upward and functions to return the blade 48 to its retracted position as shown in FIG. 6B when cutting is complete and to hold the blade in such position during running and retrieval of the cutter 22. A respective insert 49 is affixed to the lower end of the piston 56 for attaching each of the blades 48 to the piston. Each insert 49 carries a respective pin 51 which is slidably received in a slot 53 in the upper end of the blade. As more fully explained in my copending application Ser. No. 680,470, filed May 26, 1976, each of the slots 53 is extended in a generally radial direction to allow the upper end of the blade to change position with respect to the pin 51 as it moves through its arcuate path into and out of cutting position. The pins 51 transmit the longitudinal forces of the piston 56 to the blades, while the ribs 50 and mating slots 52 translate a portion of this force into a radial force and guide each blade 48 in a path which is arcuate in a longitudinal plane so that the lower end of the blade is extended radially outwardly. FIG. 6B shows the blade 48 in fully retracted position, and FIG. 5B shows the blade 48 as it is beginning to cut its swath.

In operation the well string with the apparatus previously described mounted thereon is lowered into the casing 10. When the cutter 22 reaches the level at which the casing is to be severed the apparatus may be set at such level as hereinafter described without reference to collars or joints in the casing.

The setting of the apparatus involves the manipulation of the well string by raising the well string slightly to bring the pins 36 into the horizontal slots 44 of the J-slots 38 and then rotating the string to the left to move the pins 36 into the open space 46. Thereafter, the well string 12 is lowered until the tapered surface 16 moves behind the upper gripping elements 30 and forces them into gripping engagement with the interior of the casing 10 as shown in FIG. 5A. It can be seen that the teeth of the upper gripping elements 30 are oriented so as to prevent relative downward movement of the gripping assembly with respect to the casing 10. Thus, with the apparatus in the position of FIG. 5A, the upper gripping elements 30 provide a seat for the swivel 14. Thereafter circulation through the well string 12 is commenced to actuate the cutter 22 and the well string 12 is rotated so that cutting of the casing 10 may be accomplished.

As shown in FIG. 5B multiple casing 10, 62, and 64 may be severed with the cutter 22. In such cases surrounding casings multiplications are normally cemented together so that lifting of the inner casing 10 for retrieval also will retrieve the outer casings 62 and 64 and in submarine applications will retrieve the well head equipment mounted thereon.

When the casings to be severed have been completely cut by the cutter 22 circulation of drilling fluid is stopped and rotation of the well string 12 is stopped. This allows the blades 48 to be retracted as hereinbefore described. With the blades retracted the well string 12 is raised to the position illustrated in FIGS. 6A and 6B. The raising of the well string 12 lifts the swivel 14 out from behind the gripping elements 30 so that such gripping elements are no longer in gripping engagement with the casing 10. It also brings the lower drive cone 20 with its upward and inward directed tapered surface 66 into wedging engagement behind the lower gripping elements 32 to be wedged outward into tight gripping engagement with the interior of the casing 10. The teeth of the lower gripping elements 32 are oriented so as to prevent upward movement of the gripping assembly relative to the casing 10. With the gripping assembly 18 thus set, the well string 12 is retrieved and the apparatus of the present invention together with the several casings are retrieved from the well bore.

From the foregoing it can be seen that the present invention provides an improved method and apparatus for the severing and retrieving of well casing from a well bore which may be carried out at any level independent of the location of casing joints or collars and also may be accomplished by a single round trip of the apparatus.

What is claimed is:

1. A spearing tool for telescopic disposition with a tubular well pipe or the like comprising:

a gripping assembly comprising first gripping means selectively engageable with said pipe and disengageable therefrom respectively for preventing and allowing movement of said gripping assembly with respect to said pipe in a first longitudinal direction to support said tool in said pipe, and second gripping means longitudinally spaced from said first gripping means and selectively engageable with said pipe and disengageable therefrom respectively for preventing and allowing movement of said gripping assembly with respect to said pipe in a second longitudinal direction opposite to said first direction to spear and retrieve a portion of said pipe;

an operating assembly connected to said gripping assembly and including mandrel means, first actuating means longitudinally fixed with respect to said mandrel means for selectively engaging said first gripping means with said pipe upon relative movement of said assemblies in one direction and second actuating means longitudinally fixed with respect to said mandrel means and longitudinally spaced from said first actuating means for selectively engaging said second gripping means with said pipe upon relative movement of said assemblies in another direction opposite said one direction; and movement limiting means cooperative between said assemblies to limit said relative movement of said assemblies, and selectively releasable to permit said relative movement of said assemblies.

2. A well tool for telescopic disposition with a tubular pipe or the like comprising:

a gripping assembly comprising first gripping means selectively engageable with said pipe and disengageable therefrom respectively for preventing and allowing movement of said gripping assembly with respect to said pipe in a first longitudinal direction, and second gripping means longitudinally spaced from said first gripping means and selectively engageable with said casing and disengageable therefrom respectively for preventing and allowing movement of said gripping assembly with respect to said pipe in a second longitudinal direction opposite to said first direction;

an operating assembly connected to said gripping assembly and including mandrel means extending longitudinally through said gripping assembly, actuating means carried by said mandrel means for selectively engaging said first gripping means with said pipe upon relative movement of said assemblies in one direction and for selectively engaging said second gripping means with said pipe upon relative movement of said assemblies in another direction opposite said one direction, and swivel means engageable with said gripping assembly, when said first gripping means is engaged with said pipe, to permit relative rotation of said mandrel means with respect to said gripping assembly; and movement limiting means cooperative between said assemblies to limit said relative movement of said assemblies, and selectively releasable to permit said relative movement of said assemblies.

3. The tool of claim 2 being adapted for disposition within said pipe and wherein said gripping means are each radially extendable and retractable respectively for engagement and disengagement with said pipe.

4. The tool of claim 3 wherein said operating assembly is further operative upon said extension of said first gripping means to prevent movement of said operating assembly with respect to said gripping assembly in said first direction and upon said extension of said second gripping means to prevent movement of said operating assembly with respect to said gripping assembly in said second direction.

5. The tool of claim 4 wherein said operating assembly is telescopic with said gripping assembly, said relative movement of said assemblies being telescopic movement.

6. The tool of claim 5 further comprising drag means on said gripping assembly frictionally engageable with said pipe to resist relative movement of said gripping assembly with respect to said pipe.

7. The tool of claim 2 further comprising a cutter assembly carried by said mandrel means.

8. The tool of claim 2 wherein each of said gripping means includes a set of circumferentially spaced apart gripping slips and wherein said actuating means comprises first and second longitudinally spaced apart expanders on said mandrel means each adapted to be wedged between a respective one of said sets of gripping slips to radially extend said slips.

9. The tool of claim 8 wherein said first direction is generally downwardly, wherein first expander comprises a stationary portion of said swivel means whereby said first gripping means provides a seat for said swivel means.

10. The tool of claim 9 wherein said expanders are spaced apart by a distance greater than said gripping means, said gripping assembly being disposed generally between said expanders.

11. The tool of claim 10 wherein each of said expanders comprises a generally conical member.

12. The tool of claim 10 wherein said gripping assembly includes a sleeve member interconnecting said two sets of gripping slips.

13. The tool of claim 12 wherein said movement limiting means comprises pin and slot means interengageable between said sleeve member and said mandrel means.

14. The tool of claim 13 wherein said slot means includes a closed longitudinally extending portion communicating with an open circumferentially extending portion, whereby said pin means may be removed from said slot means by longitudinal movement of said mandrel means followed by rotation of said mandrel means with respect to said gripping assembly to permit said relative movement of said assemblies.

15. The tool of claim 14 wherein said longitudinally extending portion of said slot means includes a section extending generally upwardly from said radially extending portion and a section extending generally downwardly from said radially extending portion.

16. A method of cutting and retrieving pipe and the like in a well bore with a well tool comprising an operating assembly supported on a well string, a gripping assembly connected to said operating assembly and operable thereby to engage and disengage said pipe, releasable movement limiting means cooperative between said assemblies to selectively limit and permit relative movement of said assemblies, and a cutter assembly carried by said well string, said method comprising the steps of:

a. lowering said tool into the well bore on said well string in telescopic relation with said pipe;

b. releasing said movement limiting means;

c. moving said operating assembly in one direction by means of said well string to engage said gripping assembly with said pipe thereby preventing downward movement of said tool with respect to said pipe;

d. cutting said pipe with said cutter assembly;

e. moving said operating assembly in another direction opposite said first direction by means of said well string to engage said gripping assembly with said pipe thereby preventing upward movement of said tool with respect to said pipe;

f. raising said tool and said pipe out of said well bore by means of said well string.

17. The method of claim 16 wherein step (a) includes lowering said tool into said pipe.

18. The method of claim 16 wherein step (b) includes longitudinally moving said operating assembly with respect to said gripping assembly and then rotating said operating assembly with respect to said gripping assembly.

19. The method of claim 16 wherein step (c) includes moving said operating assembly longitudinally downwardly.

20. The method of claim 16 wherein step (d) includes rotating said operating assembly with respect to said gripping assembly.

* * * * *